US005350326A

United States Patent [19]

Funami et al.

[11] Patent Number: 5,350,326

[45] Date of Patent: Sep. 27, 1994

[54] HYDRAULIC PRESSURE GENERATING DEVICE FOR POWER STEERING APPARATUS FOR OUTBOARD ENGINE

[75] Inventors: Yasuo Funami; Nobuo Miura, both of Saitama, Japan

[73] Assignee: Kabushiki Kaisha Showa Seisakusho, Gyoda, Japan

[21] Appl. No.: 16,580

[22] Filed: Feb. 10, 1993

[30] Foreign Application Priority Data

Feb. 10, 1992 [JP] Japan ..... 4-057522

[51] Int. Cl.[5] ..... B63H 25/42

[52] U.S. Cl. ..... 440/61; 114/150; 114/144 E; 318/2; 318/489; 318/675

[58] Field of Search ..... 114/150, 144 R, 144 E; 440/61, 53, 1; 180/79.1; 74/480 B; 417/326; 318/2, 489, 675

[56] References Cited

U.S. PATENT DOCUMENTS

| | | | |
|---|---|---|---|
| 4,295,833 | 10/1981 | Borst | 440/63 |
| 4,595,370 | 6/1986 | Small | 440/53 |
| 4,710,141 | 12/1987 | Ferguson | 440/61 |
| 4,744,777 | 2/1988 | Ferguson | 440/61 |
| 4,892,494 | 1/1990 | Ferguson | 440/61 |
| 4,940,107 | 7/1990 | Hanisko | 180/79.1 X |
| 4,943,756 | 7/1990 | Conley, III et al. | 318/489 X |
| 4,976,639 | 12/1990 | Rawlings et al. | 440/59 |
| 5,028,851 | 7/1991 | Wilder | 318/2 |
| 5,127,856 | 7/1992 | Kabuto et al. | 114/144 R |
| 5,219,035 | 6/1993 | Tsurumiya et al. | 180/79.1 |

FOREIGN PATENT DOCUMENTS

| | | |
|---|---|---|
| 2-504376 | 12/1990 | Japan . |
| 89/00945 | 2/1989 | PCT Int'l Appl. . |

*Primary Examiner*—Sherman Basinger
*Attorney, Agent, or Firm*—Rosen, Dainow & Jacobs

[57] ABSTRACT

A power steering apparatus for steering an outboard engine on a boat has a hydraulic cylinder unit for angularly moving a steering arm of the outboard engine, and a hydraulic pump actuatable by a motor for supplying a hydraulic pressure to the hydraulic cylinder unit. The motor is controlled by a motor driver which supplies a first amount of electric energy to the motor when the outboard engine is not steered, and supplies a second amount of electric energy, larger than the first amount of electric energy, to the motor when the outboard engine is steered.

3 Claims, 5 Drawing Sheets

HYDRAULIC PRESSURE GENERATING DEVICE FOR POWER STEERING APPARATUS FOR OUTBOARD ENGINE

BACKGROUND OF THE INVENTION

1. Field of the Invention

The present invention relates to a hydraulic pressure generating device for generating a hydraulic pressure to be supplied to a hydraulic cylinder unit that is actuatable in response to turning of a steering wheel for angularly moving a steering arm to steer an outboard engine mounted on the back of a small boat.

2. Description of the Prior Art

Some known power steering apparatus for outboard engines on boats have a hydraulic pressure generating device which utilizes the power of the outboard engine for rotating a hydraulic pump such as a vane pump, a gear pump, or a trochoid pump to supply working oil to a hydraulic cylinder unit for angularly moving a steering arm.

Since the conventional hydraulic pressure generating device relies upon the engine power at all times, even when the power steering apparatus are not in operation, the engine power is consumed in rotating the hydraulic pump and hence suffers an energy loss. It is possible to actuate the hydraulic pump with an electric motor and to energize the electric motor only when the power steering apparatus operates to steer the boat. However. because the electric motor starts to operate with a delay when the power steering apparatus is brought into operation, the hydraulic pump cannot quickly supply a hydraulic pressure to the power steering apparatus, which is therefore poor in response.

SUMMARY OF THE INVENTION

It is therefore an object of the present invention to provide a hydraulic pressure generating device for a power steering apparatus for an outboard engine, which device can reduce an energy loss when the outboard engine is not steered and can also start to operate quickly when the outboard engine is steered.

According to the present invention, there is provided a power steering apparatus for steering an outboard engine, comprising a hydraulic cylinder unit for angularly moving a steering arm of the outboard engine, a hydraulic pump for supplying a hydraulic pressure to the hydraulic cylinder unit, a motor for actuating the hydraulic pump, and a motor driver for supplying a first amount of electric energy to the motor when the outboard engine is not steered, and supplying a second amount of electric energy, larger than the first amount of electric energy, to the motor when the outboard engine is steered.

According to the present invention, there is also provided a power steering apparatus for steering an outboard engine with a hydraulic assistive force, comprising a hydraulic actuator for generating the hydraulic assistive force, an electric motor for actuating the hydraulic actuator means, and motor control means for energizing the electric motor with a smaller amount of electric energy when the outboard engine is not steered, for energizing the electric motor with a larger amount of electric energy when the outboard engine is steered.

The above and further objects, details and advantages of the present invention will become apparent from the following detailed description of preferred embodiments thereof, when read in conjunction with the accompanying drawings,

Figure 4:
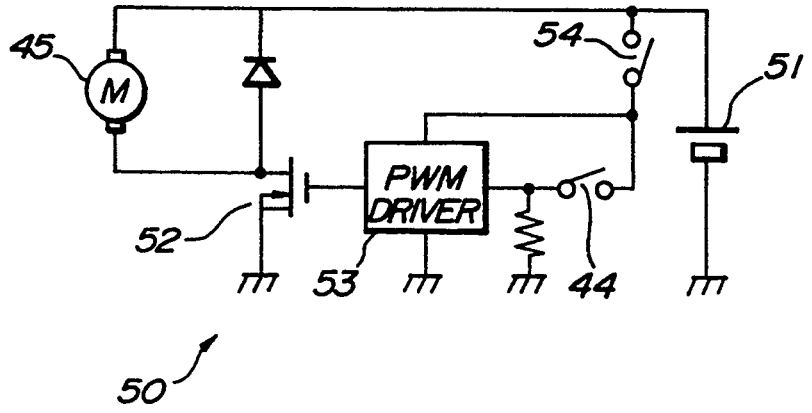
Figure 6:
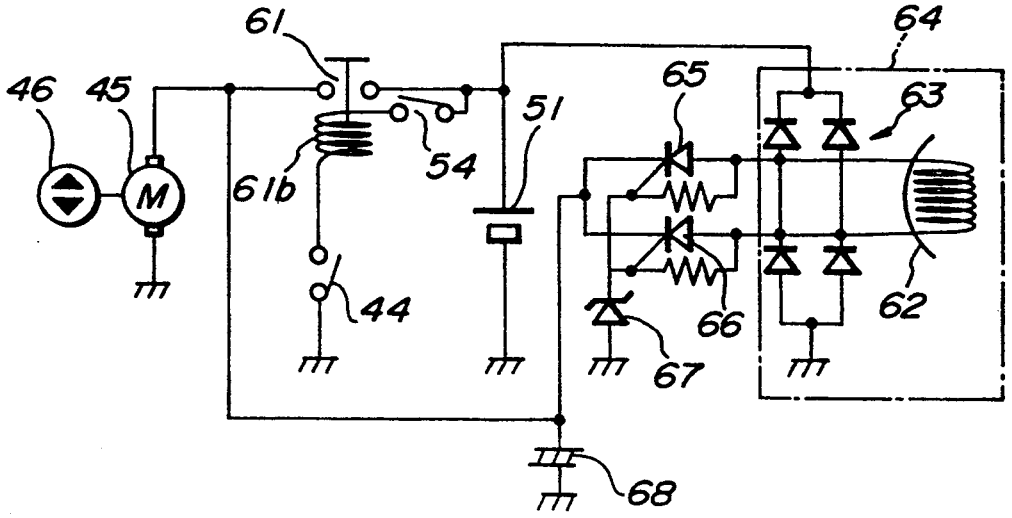
Figure 7:
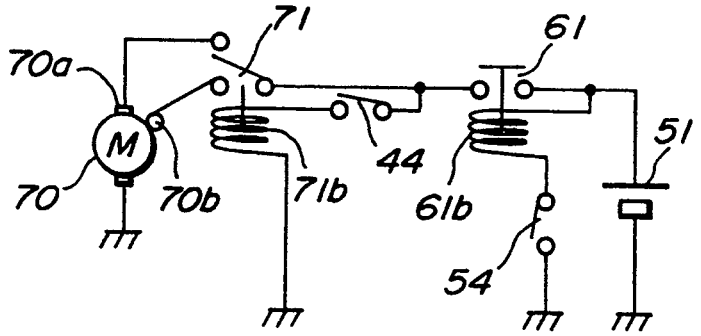
Figure 8:
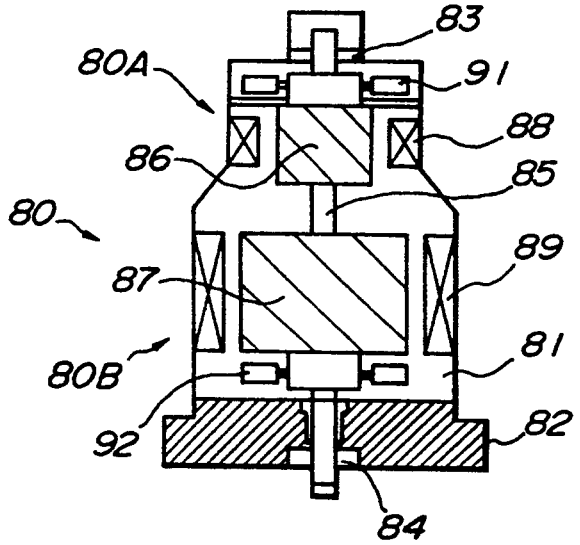
Figure 9:
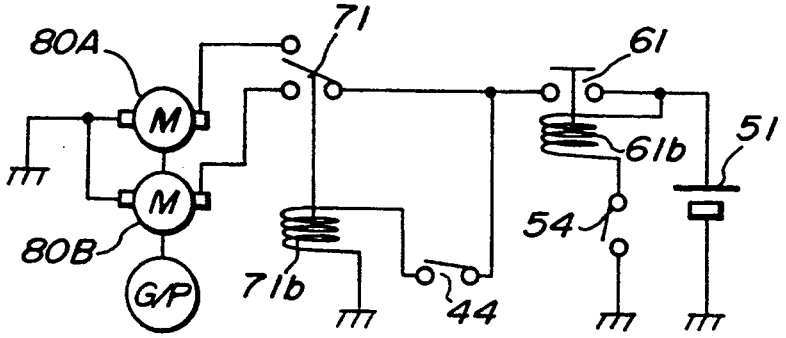

FIG, 2 is a fragmentary Cross-sectional view of a control cable;

FIG, 3 is a cross-sectional view of the power steering apparatus;

FIG, 4 is a circuit diagram of a hydraulic pressure generating device according to a first embodiment of the present invention;

FIG, 5 is a diagram showing a pulsed voltage applied to an FET by a PWM driver of hydraulic pressure generating device shown in FIG. 4;

FIG. 6 is a circuit diagram of a hydraulic pressure generating device according to a second embodiment of the present invention;

FIG. 7 is a circuit diagram of a hydraulic pressure generating device according to a third embodiment of the present invention;

FIG. 8 is a schematic view of an electric motor of a hydraulic pressure generating device according to a fourth embodiment of the present invention; and FIG. 9 is a Circuit diagram of the hydraulic pressure generating device according to the fourth embodiment of the present invention.

DETAILED DESCRIPTION OF THE PREFERRED EMBODIMENTS

Like or corresponding parts are denoted by like or corresponding reference characters throughout the figures.

Figure 1:
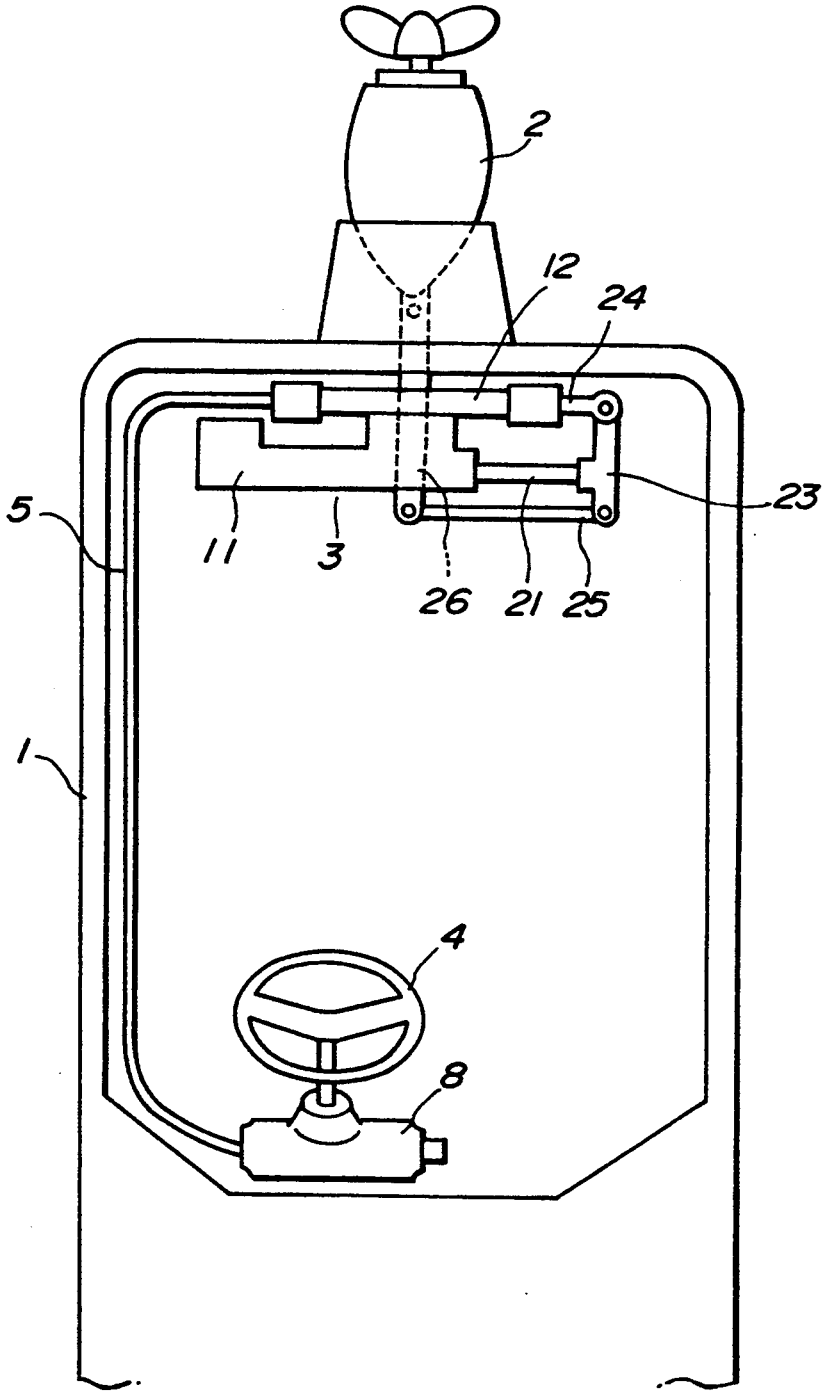
FIG. 1 is a fragmentary plan view of a boat which incorporates a power steering apparatus for an outboard engine.

As shown in FIG. 1, a boat 1 has an outboard engine 2 mounted on the stern for horizontal angular movement about a vertical axis. The outboard engine 2 can be steered by a power steering apparatus 3 positioned in the back of the boat 1 near the outboard engine 2. The power steering apparatus 3 is operatively connected to a steering wheel 4 through a control cable 5 which extends along one side of the cabin.

Figure 2:
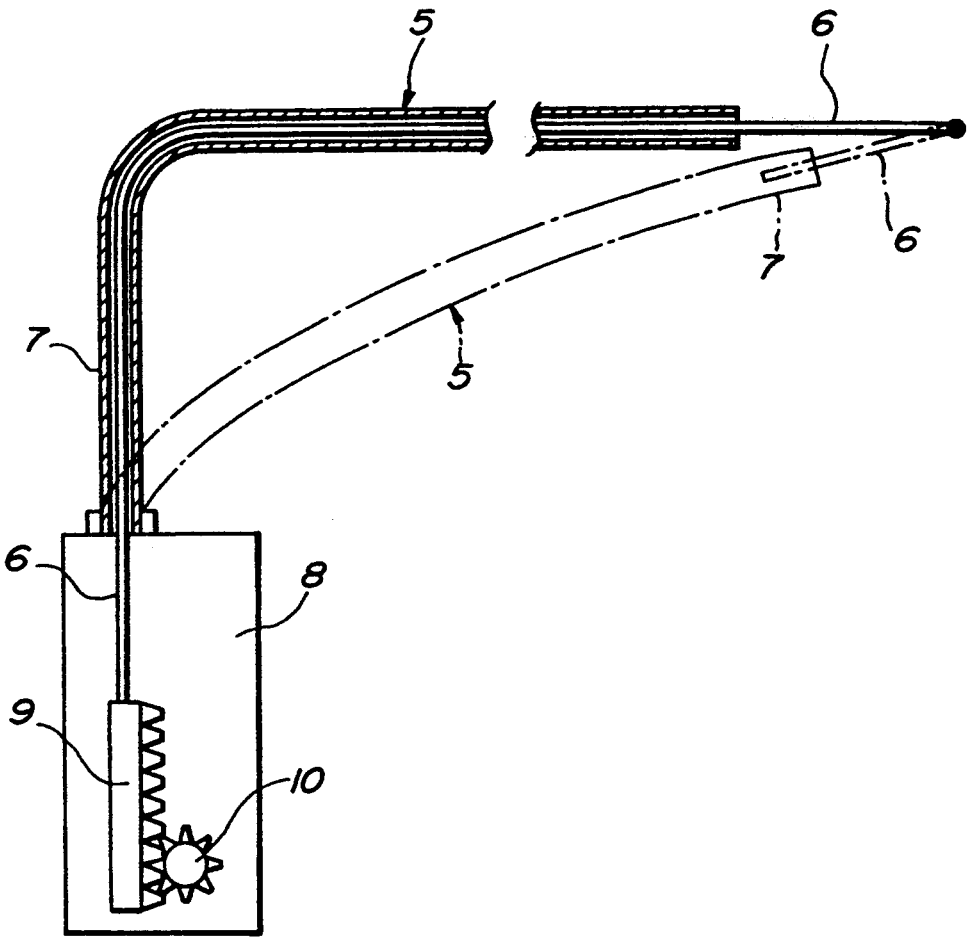

As shown in FIG. 2, the control cable 5 comprises a core 6 and a sheath 7 through which the core 6 extends. The sheath 7 has a rear end (lower end in FIG. 2) fixed to a casing 8 on which the steering wheel 4 is rotatably supported. The core 6 has a rear end extending into the casing 8 and fixed to one end of a rack 9 movably disposed in the casing 8. The rack 9 is held in mesh with a gear 10 that is rotatable about its own axis when the steering wheel 4 is turned.

Figure 3:
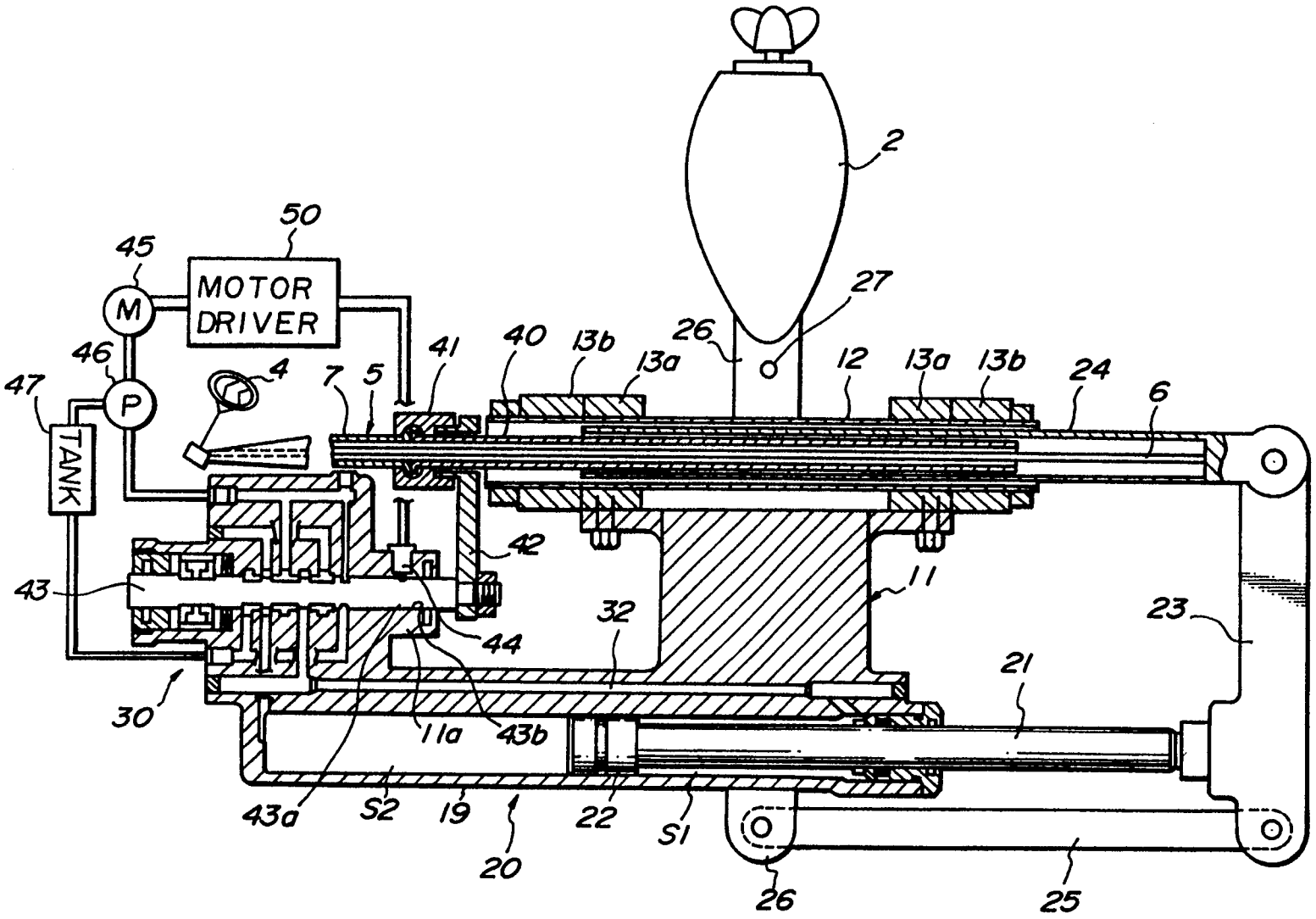

As shown in FIG. 3, the power steering apparatus 3 has a block 11 fixed to swivel brackets 13*a* which are vertically swingably supported on a tilt tube 12 that is fixed to stern brackets 13*b* mounted on the stern of the boat 1. The outboard engine 2, which is attached to the swivel brackets 13*a*, can be tilted upwardly or downwardly by a tilt cylinder (not shown).

The power steering apparatus 3 also has a hydraulic cylinder unit 20 and a directional control spool valve 30 that are assembled in the block 11.

The hydraulic cylinder unit 20 has a piston rod 21 supporting a piston 22 on one end thereof, the piston rod 21 extending substantially parallel to the tilt tube 12. The piston 22 is slidably disposed in a cylinder 19 that is divided by the piston 22 into an oil Chamber S1 through which the piston rod 21 axially extends and an oil chamber S2 remote from the piston rod 21.

The piston rod 21 has an end projecting out of the cylinder 19, and an arm 23 is fixed to the projecting end of the piston rod 21. An elongate tubular body 24 extending through the tilt tube 12 has one end fixed to one end of the arm 23. To the other end of the arm 23, there is pivotally coupled one end of a lever 25 extending parallel to the piston rod 21, the other end of the lever 25 being pivotally connected to one end of a steering arm 26 which is coupled to the outboard engine 2 for steering the same. The steering arm 26 is pivotally coupled to the boat 1 by a vertical shaft 27.

The core 6 has an end portion remote from the casing 8, the end portion extending out of the sheath 7 and into another sheath 40 which is inserted in the tilt tube 12 and extends in the tubular body 24. The end portion of the core 6 projects out of the sheath 40 and is fixed at its end to the bottom of the tubular body 24 near the arm 23. The sheath 40 has one end securely fastened coaxially to the sheath 7 by a nut 41 to which there is connected one end of a joint 42 extending transversely across the sheath 40. The other end of the joint 42 is connected to one end of a spool 43 which is axially movably fitted in a bore **43*b* defined in a block portion 11*a* in which the directional control spool valve 30** is disposed.

A motor 45 is coupled to a pump 46 for actuating the pump 46 to supply working oil from a tank 47 to the spool valve 30.

A neutral position sensor 44 such as a limit switch is mounted in the block portion **11*a* and exposed in the bore 43*b* for detecting whether the spool 43 is in a neutral position or not in coaction with an annular groove 43*a* defined in the outer circumferential surface of the spool 43. That is, when the spool 43 is in the neutral position, the limit switch 44 is turned off. When the spool 43 is not in the neutral position, i.e., when the boat is steered, the motor 45 actuates the pump 46 with full power to supply assistive working oil from the tank 47 to the spool valve 30, from which the working oil is supplied to the hydraulic cylinder unit 20**.

FIG. 4 shows a hydraulic pressure generating device according to a first embodiment of the present invention, the hydraulic pressure generating device including the motor driver 50. The motor driver 50 has an FET (field-effect transistor) 52 connected between the motor 45 and a battery 51 than is charged by a generator powered by the outboard engine 2, and a PWM (pulse-width modulation) driver 53 connected to the gate of the FET 52 for turning on and off the FET 52. The PWM driver 53 has a power terminal and a key switch 54 both connected to the battery 51, the key switch 54 being associated with the outboard engine 2. The limit switch 44 is also connected between the key switch 54 and a control terminal of the PWM driver 53.

Figure 5:
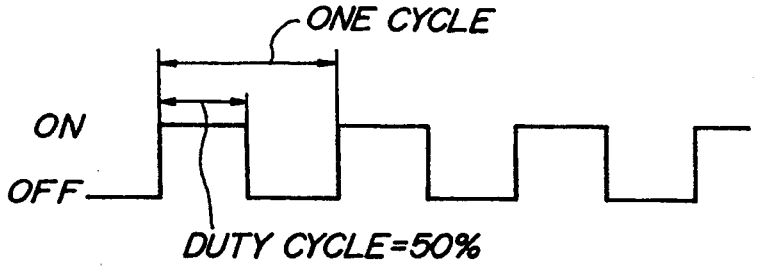

When the key switch 54 is turned on and the outboard engine 2 is in operation, the limit switch 44 is turned off as long as the spool 43 is in the neutral position, i.e., the boat is not steered. At this time, the PWM driver 53 applies a pulsed voltage to the gate of the FET 52 to alternately turn on and off the VET 52 with a relatively small duty cycle of 50%, for example (see FIG. 5). Therefore, the motor 45 is supplied with an electric current commensurate with the duty cycle of the FET 52, and continuously rotates at a low speed.

If the steering wheel 4 is turned, causing the control cable 5 to move the spool 43, then the limit switch 44 is turned on to apply a control signal to the control terminal of the PWM driver 53. The PWM driver 53 then applies a voltage to turn on the FET 52 with a duty cycle of 100%, i.e., to continuously turn on the FET Therefore, the motor 45 rotates at a higher speed, producing an output power of 100%. The hydraulic pump 46 is now actuated with full power by the motor 45 to apply a hydraulic pressure to the spool valve 30, which causes the hydraulic cylinder unit 20 to generate a steering assistive force to assist in steering the outboard engine 2.

Since the motor 45 is continuously energized with a lower power level while the boat is not being steered, the motor 45 will start quickly to actuate the pump P when the boat is to be steered and the pump P is required to supply working oil to the spool valve 30. Therefore, the power steering apparatus responds quickly to the action of the steering wheel 4 to steer the boat 1. As the motor 45 produces a lower output power when the boat is not steered than when the boat is steered, any output power loss of the outboard engine 2 is reduced.

When the key switch 54 is turned off and the outboard engine 2 is not in operation, the PWM driver 53 is de-energized and the FET 52 is fully turned off. Thus, the motor 45 is de-energized, and the electric energy store by the battery 51 is not consumed.

FIG. 6 shows a hydraulic pressure generating device according to a second embodiment of the present invention. In FIG. 6, the motor 45 is connected to the battery 51 through a relay 61 having a coil **61*b* whose one terminal is connected through the key switch 54 to the battery 51 and other terminal is connected through the limit switch 44 to ground. The battery 51 is charged by a charger 64 comprising a generator 62 and a diode bridge 63. Alternating current electric energy generated by =he generator 62 is rectified by a rectifier circuit composed of thyristors 65, 66 and a constant-voltage zener diode 67, with the rectified direct-current electric energy having a maximum value limited to a zener voltage. The rectified direct-current electric energy is smoothed by a smoother comprising a capacitor 68 and supplied to the motor 45 in bypassing relationship to the relay 61**.

The zener voltage of the constant-voltage zener diode 67 is set to a voltage value smaller than the output voltage of the battery 51. For example, if the output voltage of the battery 51 is 12 V, then the zener voltage of the constant-voltage zener diode 67 is set to 6 V.

When the key switch 54 is turned on and the outboard engine 2 is in operation, the limit switch 44 is turned off as long as the boat is not steered. At this time, the relay 61 is open, and no electric energy is supplied from the battery 51 to the motor 45. However, the constant voltage that is lower than the output voltage of the battery 51 is applied from the charger 64 to the motor 45, which continuously rotates at a low speed. When the steering wheel 4 is then turned, the limit switch 44 is turned on, closing the relay 61 to supply the electric current from the battery 51 to the motor 45. Therefore, the motor 45 rotates at a higher speed, producing an output power of 100%. The hydraulic pump 46 is now actuated with full power by the motor 45 to cause the spool valve 30 and the hydraulic cylinder unit 20 to generate a steering assistive force to assist in steering the outboard engine 2.

The zener voltage of the constant-voltage zener diode 67 Should preferably be set to a value which poses practical problem on the response to the action of the steering wheel 4 to start steering the boat 1, and which minimizes any loss current flowing through the generator 62.

FIG. 7 shows a hydraulic pressure generating device according to a third embodiment of the present invention. In FIG. 7, a motor 70 for actuating the hydraulic pump 46 (FIG. 3) has two feeder terminals 70*a*, 70*b* connected to different windings in the motor 70 such that the motor 70 rotates at a different speed when the feeder terminals 70*a*, 70*b* are selectively connected to a power supply. More specifically, the feeder terminals 70*a*, 70*b* are connected through a relay (terminal selector) 71 and the relay 61 to the battery 51. The relay 61 has a coil 61*b* connected through the key switch 54 to ground, and the relay 71 has a coil 71*b* connected through the limit switch 44 to the relay 61.

When the key switch 54 is turned on and the boat is not steered with the limit switch 44 being turned off, the movable contact of the relay 71 is connected feeder terminal 70*a* to energize the motor 70 with the electric energy from the battery 51. At this time, the motor 70 rotates at a lower speed. Since the motor 70 rotates slowly when the boat is not steered, any energy loss of the outboard engine 2 is minimized.

When the boat is steered with the limit switch 44 being turn on, the movable contact of the relay 71 is connected to the feeder terminal 70*b* to energize the motor 70 with the electric energy from the battery 51. The motor 70 now rotates at a higher speed to actuate the power steering apparatus to assist in steering the boat. Inasmuch as the motor 70 rotates slowly when the boat is not steered, the motor 70 can quickly start rotating at a higher speed to actuate the power steering apparatus when the boat is steered.

FIGS. 8 and 9 illustrate a hydraulic pressure generating device according to a fourth embodiment of the present invention. As shown in FIG. 8, the hydraulic pressure generating device employs a motor 80 comprising a single motor shaft 85 rotatably supported by bearings 83, 84 in a case composed of a housing 81 and a bracket 82. The motor shaft 85 supports an armature 86 which consumes a smaller amount of electric energy and an armature 87 which consumes a larger amount of electric energy to actuate a higher load. The housing 81 accommodates pole magnets or coils 88, 89 surrounding the armatures 86, 87, respectively, and brushes 91, 92 associated with the armatures 86, 87, respectively. The motor shaft 85, the armature 86, the pole magnet or coil 88, and the brush 91 jointly serve as a motor 80A, and the motor shaft 85, the armature 87, the pole magnet or coil 89, and the brush 92 jointly serve as a motor 80B.

As shown in FIG. 9, the motors 80A, 80B are connected parallel through the relay (motor selector) 71 and the relay 61 to the battery 51. The relay 61 has its coil 61*b* connected through the key switch 54 to ground, and the relay 71 has its coil 71*b* connected through the limit switch 44 to the relay 61.

When the key switch 54 is turned on and the boat is not steered with the limit switch 44 being turned off, the movable contact of the relay 71 is connected to the motor 80A to energize the motor 80A with the electric energy from the battery 51. At this time, the motor 80A rotates at a lower speed, i.e., consumes a smaller amount of electric energy. Since the motor 80A rotates slowly when the boat is not steered, any energy loss of the outboard engine 2 is minimized.

When the boat is steered with the limit switch 44 being turn on, the movable contact of the relay 71 is connected to the motor 80B to energize the motor 80B with the electric energy from the battery 51. The motor 80B rotates at a higher speed, i.e., consumes a larger amount of electric energy, to actuate the power steering apparatus to assist In steering the boat. Inasmuch as the motor 80A rotates slowly when the boat is not steered, the motor 80B can quickly start rotating at a higher speed to actuate the power steering apparatus when the boat is steered.

Although there have been described what are at present considered to be the preferred embodiments of the invention, it will be understood that the invention may be embodied in other specific forms without departing from the essential characteristics thereof. The present embodiments are therefore to be considered in all respects as illustrative, and not restrictive. The scope of the invention is indicated by the appended claims rather than by the foregoing description.

What is claimed is:

1. A power steering apparatus for steering an outboard engine, comprising:

a hydraulic cylinder unit for angularly moving a steering arm of the outboard engine;

a hydraulic pump for supplying a hydraulic pressure to said hydraulic cylinder unit;

a motor for actuating said hydraulic pump; and a motor drive for supplying a first amount of electric energy to said motor when the outboard engine is not steered, and supplying a second amount of electric energy, larger than said first amount of electric energy, to said motor when the outboard engine is steered, and wherein said motor driver comprises:

a first power supply for generating a first voltage;

a relay for applying said first voltage to said motor when the outboard engine is steered; and a second power supply for generating and applying a second voltage, lower than said first voltage, to said motor in bypassing relationship to said relay when the outboard engine is not steered.

2. A power steering apparatus for steering an outboard engine, comprising:

a hydraulic cylinder unit for angularly moving a steering arm of the outboard engine;

a hydraulic pump for supplying a hydraulic pressure to said hydraulic cylinder unit;

a motor for actuating said hydraulic pump; and a motor driver for supplying a first amount of electric energy to said motor when the outboard engine is not steered, and supplying a second amount of electric energy, larger than said first amount of electric energy, to said motor when the outboard engine is steered, and wherein said motor has a pair of first and second feeder terminals, and said motor driver comprises:

a power supply for generating electric energy; and a relay having a movable contact which is connectable to said first feeder terminal to supply the electric energy from said power supply to said motor through said first feeder terminal to rotate said motor at a first speed when the outboard engine is not steered, and which is connectable to said second feeder terminal to supply the electric energy from said power suply to said motor through said second feeder terminal to rotate said motor at a second speed, higher than said first speed, when the outboard engine is steered.

3. A power steering apparatus for steering an outboard engine, comprising:

a hydraulic cylinder unit for angularly moving a steering arm of the outboard engine;

a hydraulic pump for supplying a hydraulic pressure to said hydraulic cylinder unit;

a motor for actuating said hydraulic pump; and a motor driver for supplying a first amount of electric energy to said motor when the outboard engine is not steered, and supplying a second amount of electric energy, larger than said first amount of electric energy, to said motor when the outboard engine is steered, and wherein said motor comprises a pair of first and second motors having a common output shaft, and said motor driver comprises:

a power supply for generating electric energy; and a relay having a movable contact which is connectable to said first motor to supply the electric energy from said power supply to said first motor to rotate said first motor at a first speed when the outboard engine is not steered, and which is connectable to said second motor to supply the electric energy from said power supply to said second motor to rotate said second motor at a second speed, higher than said first speed, when the outboard engine is steered.

* * * * *